United States Patent [19]

Seeley

[11] Patent Number: 4,570,814

[45] Date of Patent: Feb. 18, 1986

[54] COOLER CASE CONSTRUCTION

[75] Inventor: Frederic F. Seeley, St. Marys, Australia

[73] Assignee: F. F. Seeley Nominees Pty. Ltd., South Australia, Australia

[21] Appl. No.: 497,699

[22] Filed: May 24, 1983

Related U.S. Application Data

[63] Continuation-in-part of Ser. No. 293,369, Aug. 17, 1981, abandoned.

[51] Int. Cl.[4] ..... B65D 6/22

[52] U.S. Cl. ..... 220/4 F

[58] Field of Search ..... 220/4 F

[56] References Cited

U.S. PATENT DOCUMENTS

| | | | |
|---|---|---|---|
| 2,815,880 | 12/1957 | Blatz | 220/4 F |
| 3,727,785 | 4/1973 | Lutz | 220/4 F |
| 3,809,278 | 5/1974 | Csmurik | 220/4 F |
| 4,000,827 | 1/1977 | Emery | 220/4 F |

FOREIGN PATENT DOCUMENTS

| | | | |
|---|---|---|---|
| 495139 | 10/1975 | Australia | 220/4 F |
| 71662/81 | 12/1981 | Australia . | |
| 1465605 | 12/1966 | France | 220/4 F |
| 2408979 | 7/1979 | France | 220/4 F |
| 2108083 | 5/1983 | United Kingdom | 220/4 F |
| 541730 | 3/1977 | U.S.S.R. | 220/4 F |

*Primary Examiner*—George E. Lowrance

[57] ABSTRACT

A cooler case of the evaporative type cooler the elements of which comprise a tank body, opposite side panels, a rear panel and a top panel, the assembly of these elements being effected by positioning the side panels on the upper edges of the tank walls and hinging the side panels towards one another so as to lock the side panels both to one another and to the base wall, and locking the top panel to the side panels, said locking including interengagement of barb surfaces, thereby totally eliminating metal fasteners.

7 Claims, 7 Drawing Figures

22
34
29
20
26
18
15
14
17
13
12
10
3
35
36
21
24
25
30

COOLER CASE CONSTRUCTION

This application is a continuation-in-part of U.S. patent application Ser. No. 293,369 filed Aug. 17, 1981, now abandoned.

This invention relates to improvements in the construction of a cooler case of the evaporative type cooler.

BACKGROUND OF THE INVENTION

Because of corrosion and sometimes salt deposits in evaporative coolers of the type which evaporate water into a stream of air, it is desirable to eliminate use of metal fastenings in a cooler case. Furthermore, elimination of metal fastenings reduces assembly time and also improves appearance.

In U.S. Pat. No. 3,941,271, Zarges and Zarges, there was disclosed an improvement in receptacles, and in one embodiment a receptacle side wall was provided with a hinge bolt at its lower edge, the ends of which were vertically movable in end slots in a base frame. An outwardly facing projection of the side wall rested on an inwardly directed projection of the base wall when the side wall was erected, but the side wall could be lifted and hinged inwardly. While such an arrangement was suitable for quick assembly (for example on an assembly line), the configuration was not suitable for an evaporative cooler case because of the width restrictions imposed on the side walls by the inwardly directed projections, and it is not apparent how contiguous vertical edges of side, front and rear walls could interengage.

In U.S. Pat. No. 3,917,757 Hoag there was disclosed a construction wherein contiguous vertical edges of side, front and rear walls interengaged with latch means, but screw threaded fasteners were utilised to secure the top wall, and because of this assembly line operations would necessarily be slowed down. The main object of this invention is to provide improvements whereby assembly of the cooler case can be effected by simple hinging and "snap together" operations of side, front, rear and top walls.

BRIEF SUMMARY OF THE INVENTION

In this invention there is provided a cooler case of the evaporative type cooler the elements of which comprise a tank body, opposite side panels, a rear panel and a top panel, the assembly of these elements being effected by positioning the side panels on the upper edges of the tank walls and hinging the side panels towards one another so as to lock the side panels both to one another and to the base wall, and locking the top panel to the side panels, said locking including interengagement of barb surfaces, thereby totally eliminating metal fasteners.

More specifically, in this invention a cooler case comprises a top panel, opposite side panels, a front panel, a rear panel, and a tank body having a base and upstanding side walls which terminate along their upper edges in support surfaces and an upturned flange, retaining lugs projecting inwardly into the tank body, webs extending along respective said front, side and rear panels near their lower ends supported by respective said support surfaces, and a respective engaging plate depending from each of these said panels into the tank body, each said engagement plate having lug engaging surfaces which engage respective said tank body lugs upon hinging movement of its said panel when supported by a said support surface, and interengaging barb surfaces between contiguous edges of said side panels, front panel, rear panel and top panel which interengage upon assembly by resilient deformation of said panels, but are also releasable from one another by said resilient deformation.

In the assembly of the cooler case, the front, side and rear panels may be quickly dropped onto, and located by the tank body support surfaces, the panels all sloping outwardly slightly. Hinging of the panels about these surfaces causes the engagement plates to engage the tank body lugs, thereby eliminating possibility of upward displacement from the tank body, and at the same time the barb surfaces interengage between contiguous vertical edges of the side, front and rear panels. The top panel can then be snapped into position, again by interengagement of barb surfaces. Provision is made for release of the barb surfaces, for example, for cleaning or maintenance purposes.

By utilising barb surfaces for interengagement of the side and back panels with the top panel and front panel, assembly can be effected very quickly and easily and no metal fastenings are required. Interengagement between the engagement plates and tank body lugs is very positive, and the barb interengagement is restrained against inadvertent release. It is of course necessary that a cooler case be capable of being easily dismantled for maintenance purposes, and this invention provides that facility. However, disassembly can be achieved only with a tool of suitable shape for releasing the barbed surfaces, not for example with a turn-screw or spanner. This is an important safety provision.

BRIEF DESCRIPTION OF THE DRAWINGS

An embodiment of the invention is described hereunder in some detail with reference to and is illustrated in the accompanying drawings in which.

DETAILED DESCRIPTION OF THE PREFERRED EMBODIMENT

Figure 1:
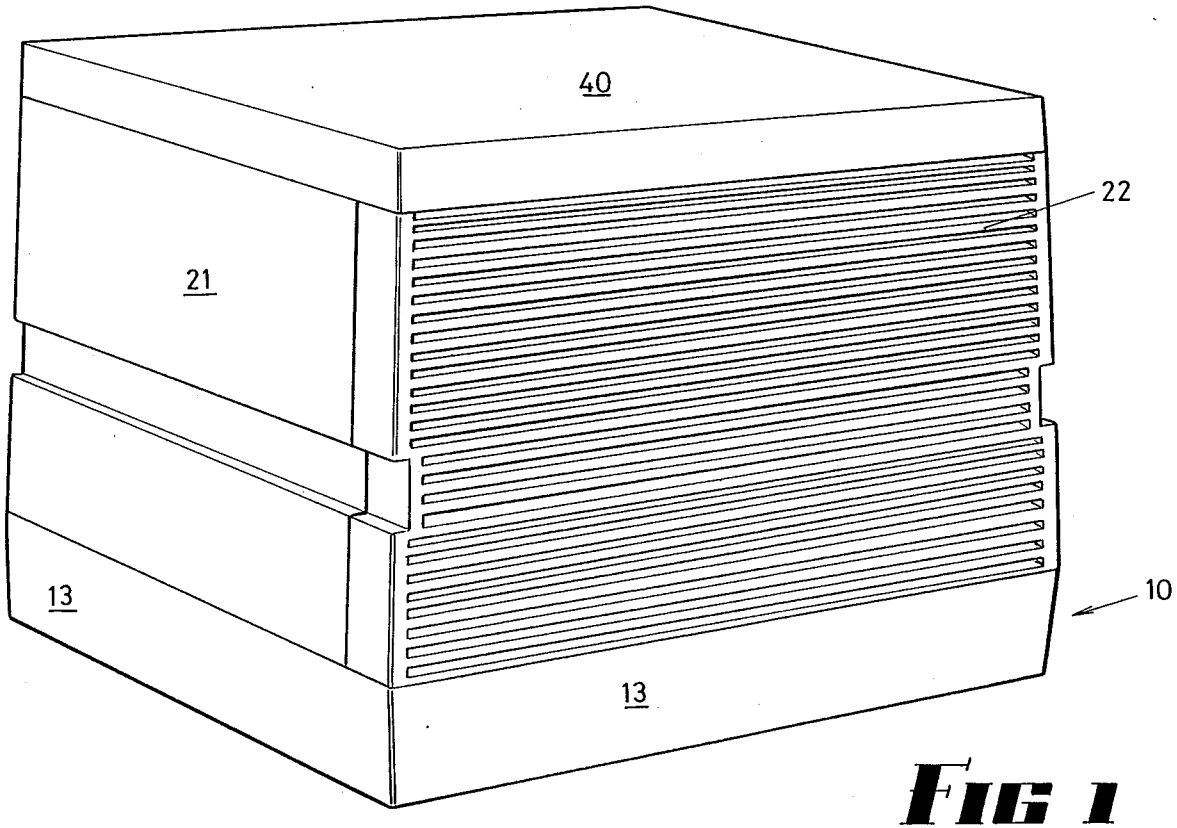
FIG. 1 is a perspective view of a cooler case.
Figures 2, 3:
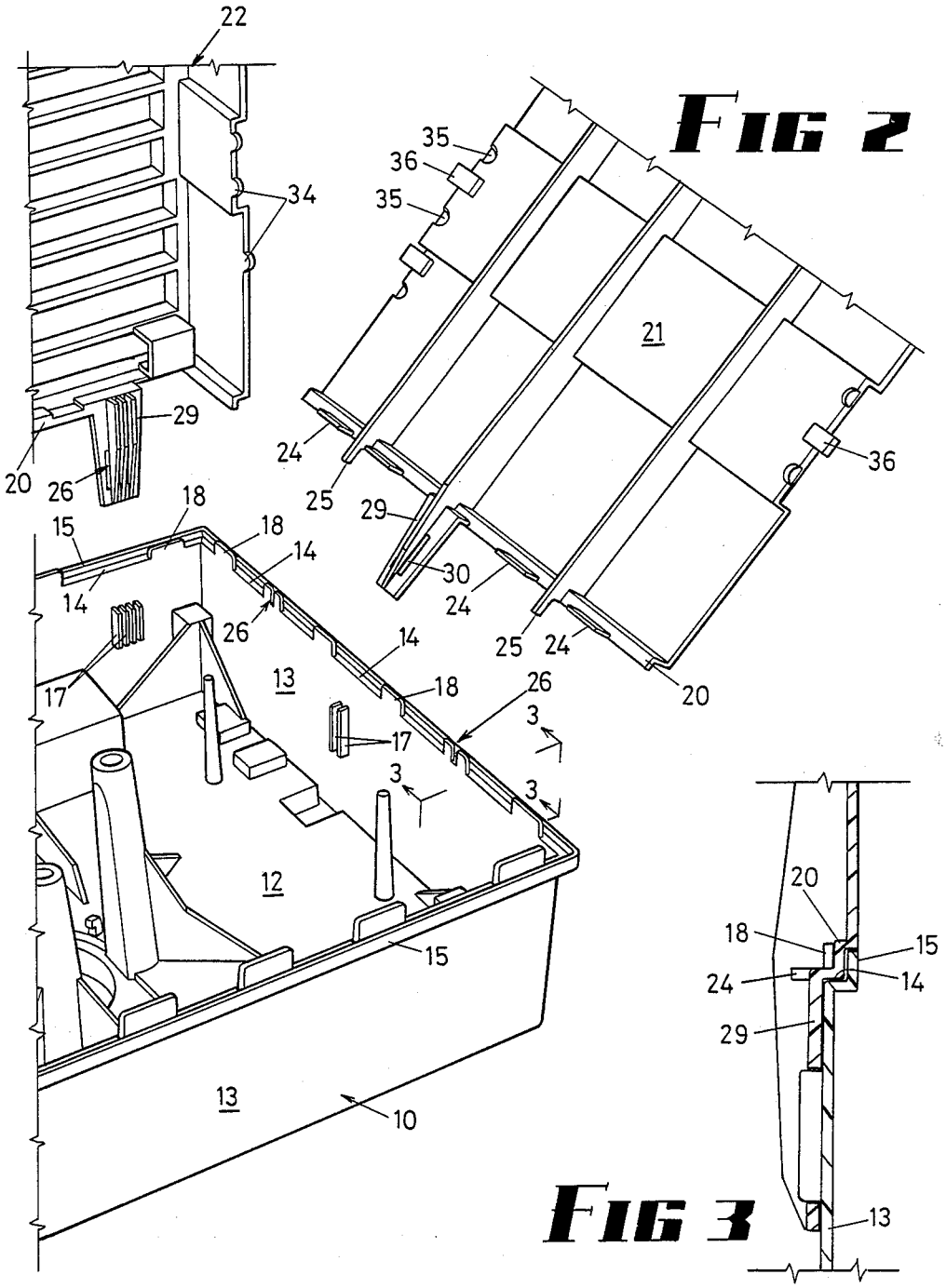
FIG. 2 is a fragmentary perspective "exploded" view showing the interconnection between the lower edges of a side panel and rear panel, and a side wall of a tank body.
FIG. 3 is a section taken on plane 3—3—3—3 of FIG. 2 when assembled, and drawn to an enlarged scale.

In this embodiment a tank body 10 for a cooler case of an evaporative type cooler comprises a base wall 12 and four peripheral upstanding side walls 13. Each of the side walls 13 terminates along its upper edge in a support surface 14 and an upturned flange 15, and the inner surfaces of the side walls 13 have lugs 17 extending inwardly. All are of moulded, deformable polymeric material. Other details of the tank body 10 are as shown but are not pertinent to this invention. The support surfaces 14 also have upstanding projections 18 which are spaced inwardly from the upturned flange 15 and which form abutment means of the inner surfaces of downturned flanges 20 of side panels 21, front panel 22 and rear panel 23. Side panels 21 are also provided with depending lugs 24 which locate between adjacent projections 18 and thereby give ready location of the side panels when they are positioned on the support surfaces 14. When so positioned, the side panels will remain sloping upwardly and outwardly from the side walls 13 of the tank body 10. Projecting webs 25 frictionally engage in respective slots 26 in a pair of upstanding projections 18 and further assist in retention of the side panels 21 at this stage.

The side panels 21 are provided with engaging plates 29 which project downwardly into the tank body, and which contain slots 30 which engage over the lugs 17 of the tank side walls 13 when the side panels 21 are pivotted on the support surfaces 14, and these so interengage the side panels 21 and the side walls 13 that the panels cannot be moved in any direction other than again being tilted outwardly.

Similarly, the front panel 22 has a pair of engaging plates 29 also having therein slots 26 which engage over the lugs 17. Since the lugs 17 are relatively thin, there is little evidence of their existence on the outer face of the side walls 13, shrinkage being minimised. Although not separately illustrated herein, the rear panels 23 similarly have depending engaging plates 29 which engage lugs 17.

Figure 7:
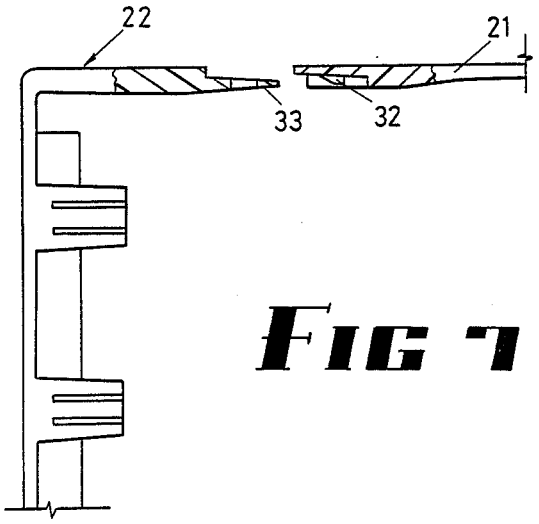
FIG. 7 is a fragmentary plan section showing interconnection of the front and side panels.

The side panels 21 are provided with small projecting studs 32 (FIG. 7) and these are engaged in a barb-like manner by aperture tabs 33 which project rearwardly from the front panel 22, after the side panels 21 have been tilted to their erect positions and the front panel 22 is tilted into its erect position. Secondary tabs 34 on the front panel engage in recesses 35 on the side panel for location purposes. Interleaving is effected by the projections 36 which project from the ends of the side panels 21, the interleaving also being effective for the rear panel 23.

Figure 4:
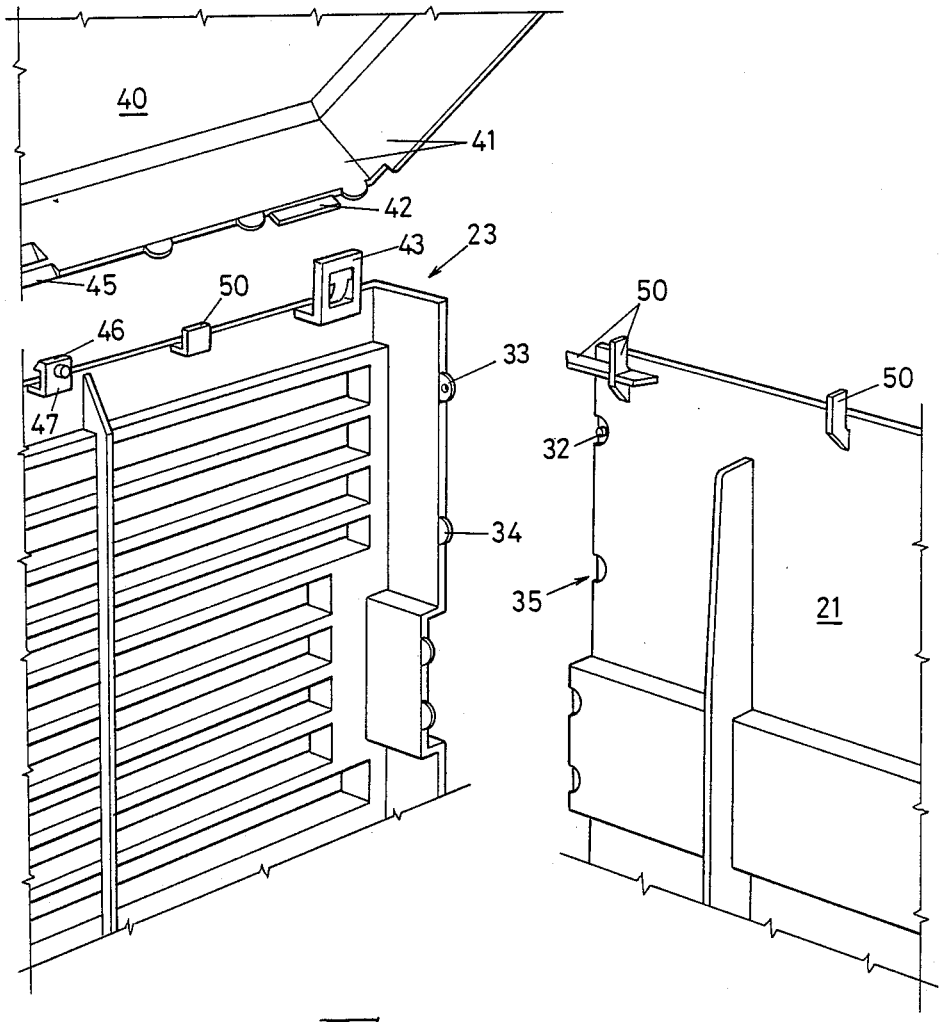
FIG. 4 is a fragmentary "exploded" view showing the interconnection between the upper edges of a side panel, rear panel and upper panel.
Figure 5:
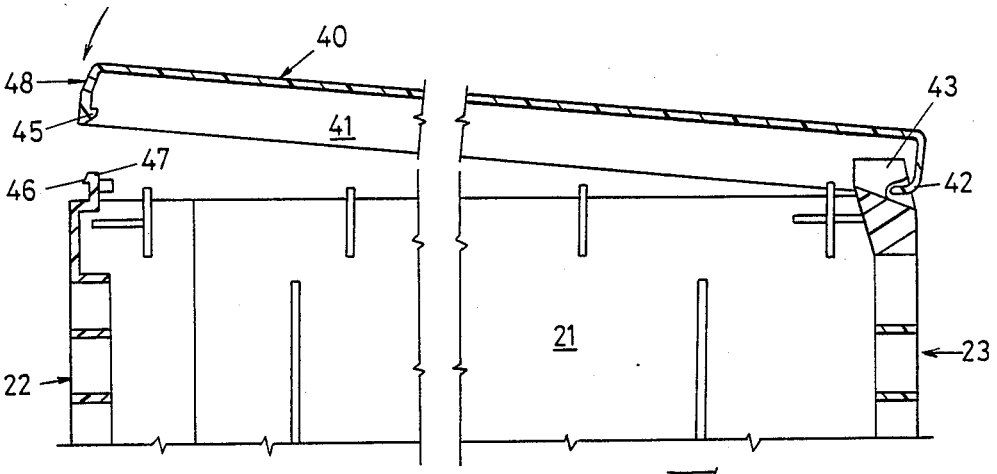
FIG. 5 is a fragmentary elevational section which illustrates the snap-together assembly of the upper panel to the front, side and top panels.
Figure 6:
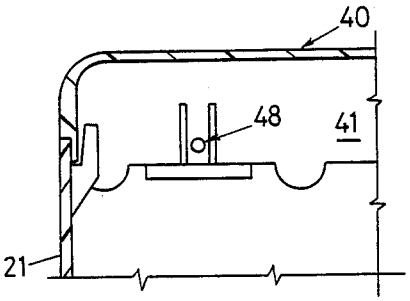
FIG. 6 is a fragmentary elevational section showing location of the top panel with a side panel.

The top panel 40 is provided with a downturned flange 41 on all sides, and this has engaging tongues 42 as illustrated in FIGS. 4 and 5. The top panel 40 can thereby hinge downwardly from the rear panel 23 and engage the front panel 22 with the interengaging barbs 45 and 46. The barb 46 however is on an upstanding projection 47 which can be deflected inwardly if a pin is inserted into aperture 48, for removal of the top panel 40. All panels have upwardly or sideways projecting location webs 50 which assist in ready location and interengagement.

In assembly therefore all that is necessary is for two side panels 21 to be quickly located on the support surfaces 14, and temporarily retained by the tank body 10 to slope upwardly and outwardly. By merely tilting the side panels, the engaging plates 29 frictionally engage lugs 17 and temporarily retain the side panels 21 in their erect positions. In some embodiments, the lugs 17 are not rectangular in side elevation, as shown, but reduce in thickness towards the top, and this further facilitates engagement of plates 29, which can then alternatively be moved vertically downwardly to engage the lugs 17. Simple tilting of the front panel 22 not only engages engaging plates 29 over lugs 17 but also interengages the barb projections 32, being the studs shown in FIGS. 4 and 7. The rear panel is similarly tilted to its erect position and interengages the rear edges of the side panels 21. The top panel 40 is then hooked over the retaining lugs 43 and snapped into position, by interengagement of the barbs 45 and 46.

Removal of the top panel is achieved by inserting a pin like tool successively through apertures 48 and deflecting projections 47 inwardly to release barbs 45 and 46, there being four such barb interconnections across the rear of the body, and when these have been released the top panel 40 can be lifted off, providing access to the interengaging portions between the front panel, side panel and rear panel.

Various modifications in structure and/or function and/or steps may be made to the disclosed embodiments by one skilled in the art without departing from the scope of the invention as defined by the claims.

What is claimed is:

1. A cooler case comprising opposite side panels, a front panel, a rear panel, and a tank body, said tank body having a base and upstanding side walls which terminate along their upper edges in horizontal support surfaces having an outer upturned flange, a plurality of projections upstanding from the support surfaces and spaced inwardly from said upturned flange and spaced from one another, and retaining lugs projecting inwardly into the tank body from the side walls thereof, flanges projecting inwardly from said side, front, and rear panels at their respective lower edges to be supported by respective side wall support surfaces, each said flange also having at the inner edge thereof a downturned flange which, upon assembly, abuts said upstanding projections, the lower edges and also having inwardly directed lugs which, upon assembly are located between adjacent said upstanding projections and thereby locate said panels with respect to said tank body, each said panel also having a respective engaging plate depending from the lower edge thereof into the tank body, each said engaging plate having lug engaging surfaces which frictionally engage respective said tank body retaining lugs upon hinging movement of the respective said panel to an erected position when supported by said support surface, said case also having a top panel, each contiguous edge of said side panels, front panel, rear panel and top panel having barb surfaces which interengage upon assembly by resilient deformation of said panels but are also releaseable from one another by said resilient deformation.

2. A cooler case according to claim 1 wherein each contiguous edge of the side panels, front panel and rear panel is a vertical edge and one edge of the top panel has barb surfaces.

3. A cooler case according to claim 1 wherein said top panel has at an edge thereof a peripheral downturned flange, engaging tongues on the top panel downturned flange which engage complementary surfaces on one of said panels, and interengaging barb surfaces on the top panel downturned flange and the panel opposite said complementary surfaces.

4. A cooler case according to claim 3 wherein said top panel downturned flange contains apertures at the locations of respective said barb surfaces, so located that a pin-like tool, when inserted through a said aperture, can deflect the front panel to release the relevant barb surfaces from their interengagement.

5. A cooler case according to claim 1 wherein said tank body and each said panel comprises deformable polymeric material.

6. A cooler case according to claim 3 wherein some at least of said panels comprise projecting locating tabs which engage respective recesses in adjacent panels at the locations of contiguous edges of the panels.

7. A cooler case construction according to claim 1 wherein the lug engaging surfaces comprise surfaces defining a slot, said surfaces frictionally engaging said tank body lugs.

* * * * *